US011448054B2

(12) United States Patent
Almarri et al.

(10) Patent No.: US 11,448,054 B2
(45) Date of Patent: Sep. 20, 2022

(54) INTEGRATED METHODS FOR REDUCING FORMATION BREAKDOWN PRESSURES TO ENHANCE PETROLEUM RECOVERY

(71) Applicant: Saudi Arabian Oil Company, Dhahran (SA)

(72) Inventors: Misfer Almarri, Dhahran (SA); Waheed Syed Arshad, Dhahran (SA); Adel Ali Al-Qahtani, Dhahran (SA)

(73) Assignee: SAUDI ARABIAN OIL COMPANY

( * ) Notice: Subject to any disclaimer, the term of this patent is extended or adjusted under 35 U.S.C. 154(b) by 74 days.

(21) Appl. No.: 16/878,446

(22) Filed: May 19, 2020

(65) Prior Publication Data

US 2021/0363868 A1 Nov. 25, 2021

(51) Int. Cl.

| | |
|---|---|
| ***E21B 43/26*** | (2006.01) |
| ***E21B 36/00*** | (2006.01) |
| ***E21B 43/24*** | (2006.01) |
| ***E21B 43/267*** | (2006.01) |
| ***E21B 49/00*** | (2006.01) |
| ***E21B 7/18*** | (2006.01) |
| ***E21B 37/00*** | (2006.01) |

(52) U.S. Cl.

CPC ..... *E21B 43/26* (2013.01); *E21B 7/18* (2013.01); *E21B 36/001* (2013.01); *E21B 37/00* (2013.01); *E21B 43/2405* (2013.01); *E21B 43/267* (2013.01); *E21B 49/00* (2013.01)

(58) Field of Classification Search

CPC ..... E21B 43/26; E21B 43/305; E21B 43/24; E21B 43/30; E21B 43/267

See application file for complete search history.

(56) References Cited

U.S. PATENT DOCUMENTS

| | | | |
|---|---|---|---|
| 7,571,766 | B2 | 8/2009 | Pauls et al. |
| 7,730,951 | B2 | 6/2010 | Surjaatmadja et al. |
| 7,980,312 | B1 | 7/2011 | Hill et al. |
| 2005/0211439 | A1 | 9/2005 | Willett et al. |
| 2006/0201674 | A1 | 9/2006 | Soliman et al. |
| 2010/0243242 | A1 | 9/2010 | Boney et al. |

(Continued)

FOREIGN PATENT DOCUMENTS

| | | | | |
|---|---|---|---|---|
| CA | 2908618 | A1 * | 10/2014 | ..... C09K 8/703 |
| CA | 2913609 | A1 | 5/2017 | |

(Continued)

OTHER PUBLICATIONS

International Search Report and Written Opinion of PCT Application No. PCT/US2021/033032 dated Aug. 9, 2021: pp. 1-14.

(Continued)

*Primary Examiner* — Zakiya W Bates

(74) *Attorney, Agent, or Firm* — Bracewell LLP; Constance Gall Rhebergen

(57) ABSTRACT

A method of increasing hydrocarbon recovery from a wellbore in a tight formation with greater breakdown pressures, the method including using hydro-jetting to effect a plurality of oriented cavities or discoidal grooves in the horizontal portion of the wellbore to overcome near-wellbore stresses, injecting a thermally controlled fluid into the wellbore to alter the temperature of the formation and lower stresses, and then fracturing the formation to generate a series of fractures that can be formed in a planar formation.

12 Claims, 3 Drawing Sheets

(56) References Cited

U.S. PATENT DOCUMENTS

| | | | | |
|---|---|---|---|---|
| 2011/0061869 | A1 | 3/2011 | Abass et al. | |
| 2012/0118568 | A1 * | 5/2012 | Kleefisch | E21B 7/14 166/297 |
| 2016/0160619 | A1 | 6/2016 | Randall | |
| 2018/0266183 | A1 | 9/2018 | Ayub | |

FOREIGN PATENT DOCUMENTS

| | | | | |
|---|---|---|---|---|
| WO | WO-2012058028 | A1 * | 5/2012 | E21B 43/26 |
| WO | 2018017110 | A1 | 1/2018 | |
| WO | 2019027489 | A1 | 2/2019 | |

OTHER PUBLICATIONS

Abass, H.H et al., "A New Technique to Hydraulically Fracture Openhole Horizontal Well." Oriented Fracturing:SPE 124483, Oct. 2009.

Andrade, A., "Thermal Induced Fracture Effect with a Lower Cool down Reduction—Case Studies for Ecuador; Villano and CPF Water Disposal Wells", Society of Petroleum Eng, SPE177155, p. 1-21, (2015).

Bartko, K. et al.; "First Application for a Sequenced Fracturing Technique to Divert Fractures in a Vertical Open Hole Completion: Case Study from Saudi Arabia", Society of Petroleum Eng. SPE179127, 2016, p. 1-15.

Cai, C, et al., "A Waterless Fracturing Treatment: Liquid Nitrogen Fracturing and its Application Prospect" China University of Petroleum, published in 2015.

Chang, F., et al. "Multiple Fracture Initiation in Openhole without Mechanical Isolation: First Step to Fulfill an Ambition". Society of Petroleum Engineers SPE168638, Feb. 4, 2014, p. 1-18.

Enayatpour, S. et al., "Thermal Cooling to Improve Hydraulic Fracturing Efficiency and Hydrocarbon Production in Shales", Journal of Natural Gas Science and Engineering 62 (2019) 184-201, WWW.elsevier.com, 18 pages.

Goodarzi, S.,"Thermal Aspects of Geomechanics and Induced Fracturing in CO2 Injection With Application to CO2 Sequestration in Ohio River Valley," SPE139706 presented at SPE International Conference on CO2, 2010; p. 1-8.

Kayumov, R, et al., "Efficient Large Volume Acid Fracturing in Openhole Horizontal Well with Pre-Created Circular Notches". Society of Petroleum Engineers, SPE194779, Mar. 15, 2019, pp. 1-14.

* cited by examiner

INTEGRATED METHODS FOR REDUCING FORMATION BREAKDOWN PRESSURES TO ENHANCE PETROLEUM RECOVERY

BACKGROUND

Field

The present disclosure relates generally to the enhanced recovery of hydrocarbons in a hydrocarbon-bearing formation by fracturing the formation. Specifically, the disclosure relates to facilitating formation breakdown and enhancing hydraulic fracturing in subterranean zones.

Description of the Related Art

In many instances, hydrocarbon-bearing reservoirs with trapped reserves within certain lesser permeability formations, such as certain tight sandstone, carbonate, and/or shale formations, exhibit little or no production, and are thus economically undesirable to develop at current oil and gas prices. Well stimulation is one method that is frequently employed to increase the net permeability of a formation or reservoir, thereby leading to increased production from wells that have little or no production. Oil and gas wells in tight reservoirs are stimulated by hydraulic fracturing (also referred to as "fracturing" or "fracking"), which is a process in which a fluid is injected into a segment or interval of the wellbore under pressure until the fluid breaks or cracks the rock. These cracks are referred to as "hydraulic fractures" or simply "fractures." Fracturing is a field practice to enhance production from otherwise uneconomic wells, and allows for increased hydrocarbon recovery for certain hydrocarbon formations. In general, fracturing processes may be carried out using completions that will isolate part of a vertical or horizontal well section, perforate casing if the well is cased, and then pump the fracturing fluid to initiate and propagate fractures in one or more lateral extensions which create new or additional flow channels through which hydrocarbons can more readily move from the formation into a producing wellbore.

In some cases, tight formations have greater stress values, and rock with greater compressive strength values creates difficulty propagating fractures using hydraulic fracturing. High breakdown pressures can be an impediment to hydraulic fracturing. Formation breakdown failure is one of the major challenges that operators face when fracturing tight and high stress reservoirs. In order to adequately fracture a tight rock formation, a fluid with a pressure at least equal to the breakdown pressure of the formation is needed. Breakdown pressure, or fracture initiation pressure, is the pressure required to induce a hydraulic fracture in situ and initiate a crack or fracture that allows fluids to flow inside the formation. In some cases, though, the breakdown pressure may be so great that the injectivity is too low to develop a fracture, or the fracturing cannot be performed in conventional means within the pressure limits of the completion tubulars. Assuming the formation rock is linear elastic and has a tensile failure strength $T_0$, the breakdown pressure $P_b$ for fracturing the formation can be estimated by the Haimson-Fairhurst expression for permeable rocks, as shown in Formula 1:

$$P_b = \frac{3\sigma_h - \sigma_H + T_0 - 2\eta P_0}{2(1-\eta)}. \qquad \text{FORMULA 1}$$

In Formula 1, $P_b$ is the breakdown pressure in pounds per square inch (psi); $\sigma_h$ is the minimum horizontal in-situ stress in psi; $\sigma_H$ is the maximum horizontal in-situ stress in psi; $T_0$ is the tensile strength of the rock formation in psi; $P_0$ is the pore pressure in psi; and $\eta$ is the poroelastic parameter in the range of 0 to 0.5.

A high breakdown pressure could be caused by a high minimum stress gradient which translates into a high hydraulic pressure that can exceed the capacity of the downhole tubulars or surface equipment. Normally a certain minimum volume of fluids needs to be injected to initiate a tensile fracture, referred to as initiating breakdown. Deep, tight reservoirs can further aggravate formation breakdown due to poor injectivity since not enough fluid can be injected to achieve the fracture initiation. There appears to be a direct correlation between lower permeability and high breakdown pressure though it cannot be used as a standalone indicator of high formation breakdown pressure.

Even if initial breakthrough is achieved in tight formations, some formations may not have sufficient permeability to allow sufficient injection rates to propagate the fracture and transport the fracturing fluids and proppant into the reservoir. With a tight formation, possibly with less than 1 millidarcy permeability, and high breakdown pressures, even if the breakdown pressure is achieved and fractures are formed, the fracture propagation is limited to being narrow. Reservoirs can be abandoned where high breakdown pressures exceed pumping limitations or completion tubular pressure ratings. In certain wells, achieving breakdown pressures within the completion tubular yield limit is not possible, and those zones may have to be abandoned without fracturing.

Existing hydraulic fracturing processes are often inadequate in effectively lowering breakdown pressures or generating sufficient fluid injectivity to initiate a fracture or propagate it in low permeability tight rock formations and as a result do not deliver improved hydrocarbon recovery.

SUMMARY

The present disclosure shows a hydrocarbon recovery method of generating fractures in tight gas reservoir formations using oriented cavities and thermally controlled fluid injection to increase hydrocarbon recovery. In some embodiments, a hydro-jetting fluid containing abrasive material and water is injected into a wellbore. The wellbore has been formed in a tight gas reservoir formation, or alternatively in the embodiments described a low-permeability, high-breakdown-pressure oil formation. The wellbore has a vertical portion and a horizontal portion, and the horizontal portion has a diameter D. A downhole tool in the horizontal portion of the wellbore directs a hydro-jetting fluid at a pressure of about 2000 psi or more to create oriented cavities. The oriented cavities extend radially outward and are substantially perpendicular to the horizontal portion of the wellbore. The oriented cavities can extend outward from the horizontal portion of the wellbore of a distance of about one and a half times D (the wellbore diameter) or greater. A thermally controlled fluid is injected into the wellbore. The temperature of the thermally controlled fluid is selected to alter the temperature of the tight gas reservoir formation or other applicable formation, such as the low-permeability, high-breakdown-pressure oil formation. The tight gas reservoir formation can be fractured to generate a multitude of planar fractures.

In some embodiments, the method is effected in a tight gas reservoir formation, or low-permeability, high-breakdown-pressure oil formation, that has a Young's modulus within a range of about 6 to about 10 Mpsi and a stress gradient in a range of about 0.8 to about 1.40 psi/ft. In some embodiments, the tight gas reservoir formation can be at a temperature greater than the ambient temperature at the surface of the wellbore, and the thermally controlled fluid can be at a lesser temperature than the tight gas reservoir formation, for example lesser than ambient surface temperature. In other embodiments, the tight gas reservoir formation can be at a temperature lesser than the ambient temperature at the surface of the wellbore, and the thermally controlled fluid can be at a greater temperature than the tight gas reservoir formation, for example greater than ambient temperature at the surface.

In some embodiments, the step of injecting the thermally controlled fluid into the wellbore can be carried out after the step of creating the oriented cavities via hydro-jetting. In some embodiments, the oriented cavities can be generated substantially perpendicular to the horizontal portion of the wellbore and can also be positioned generally parallel to the vertical portion of the wellbore.

In some embodiments, the planar fractures can be generated in a direction of the maximum horizontal stress of the tight gas reservoir formation. In some embodiments, the planar fractures can be generated transverse to the horizontal portion of the wellbore.

In yet more embodiments, the amount of time the thermally controlled fluid is required to be injected into the wellbore to change the temperature of the tight gas reservoir formation near the wellbore area to reduce the stresses of the tight gas reservoir formation in the near wellbore area can be determined by modeling or simulation, and the thermally controlled fluid can be injected into the wellbore for that amount of time.

In some embodiments, the oriented cavities have a diameter of at least approximately 2 inches.

The present disclosure also shows a hydrocarbon recovery method of generating fractures in hydrocarbon formations using oriented cavities and thermally controlled fluid injection to increase hydrocarbon recovery from tight hydrocarbon formations. A hydro-jetting fluid containing abrasive material and water is injected into a wellbore, which has been formed in a tight gas reservoir formation that has a Young's modulus within a range of about 6 to about 10 Mpsi and a stress gradient in a range of about 0.8 to about 1.40 psi/ft, and a formation temperature. The wellbore has a vertical portion and a horizontal portion.

The method further includes creating one or more jets of the hydro-jetting fluid in the horizontal portion of the wellbore at a pressure of about 2000 psi or more to scour oriented cavities in the horizontal portion of the wellbore. The oriented cavities are positioned to be substantially perpendicular to the horizontal portion of the wellbore and extend radially outward from a predetermined distance to overcome near-wellbore stresses. The method further includes cooling the tight gas reservoir formation by injecting a thermally controlled fluid that is at a fluid temperature substantially lower than the formation temperature into the wellbore for a time period long enough to reduce stresses in the tight gas reservoir formation as determined by the reservoir properties. A fracturing fluid is injected into the wellbore, and the fracturing of the tight gas reservoir formation with the fracturing fluid generates a plurality of fractures.

In an embodiment, the fracturing fluid can be the same as the thermally controlled fluid. In other embodiments, the thermally controlled fluid is not a fracturing fluid and does not contain for example viscous fluid components such as guar or hydroxyethylcellulose, and does not contain proppants. In an embodiment, the method includes the step of removing any debris created from the scouring of the oriented cavities from the oriented cavities and transporting the debris into the wellbore.

In some embodiments, the fractures are generated approximately in a planar configuration. In an embodiment, the planar configuration can be oriented transverse to the wellbore. In an embodiment, the planar configuration is oriented along the direction of maximum horizontal stress. In an embodiment, the oriented cavities can be at least approximately 2 feet long with a diameter of approximately 2 inches. In an embodiment, the abrasive material includes sand. In an embodiment, the method further includes the step of introducing a proppant to the fractures. In an embodiment, isolating of the horizontal portion of the wellbore before the step of fracturing the formation does not occur. In an embodiment, the fracturing fluid is the same as the thermally controlled fluid and the hydro-jetting fluid. In an embodiment, the reservoir properties which in an embodiment influences the time period of cooling through injecting the thermally controlled fluid required to reduce stresses in the tight gas reservoir formation include at least one property selected from the group consisting of: breakdown pressure, minimum horizontal in-situ stress, maximum horizontal in-situ stress, tensile strength, pore pressure, poroelastic parameters, coefficient of thermal expansion, and the formation temperature. In an embodiment, the formation temperature is in the range of about 200° F. to 350° F. In an embodiment, the temperature of the thermally controlled fluid is between about −60° F. to 40° F.

In an embodiment, the method further includes the steps of calculating a current breakdown pressure of the tight gas reservoir formation using a breakdown pressure formula populated with characteristics of the tight gas reservoir formation, where the breakdown pressure formula is $$P_b = \frac{3\sigma_h - \sigma_H + T_0 - 2\eta P_0}{2(1-\eta)}$$

where $P_b$ is the current breakdown pressure in psi; $\sigma_h$ is a minimum horizontal in-situ stress in psi; $\sigma_H$ is a maximum horizontal in-situ stress in psi; $T_0$ is a tensile strength in psi; $P_0$ is a pore pressure in psi; and $\eta$ is a poroelastic parameter in the range of 0 to 0.5. The method further includes calculating a required reduction in the current breakdown pressure such that the tight gas reservoir formation has a final breakdown pressure of below 10,000 psi, or less than 8,000 psi, or less than 6,000 psi, and calculating a treatment fluid temperature required to meet the required reduction in the current breakdown pressure by using the formula $$\Delta\sigma_T = \frac{E}{(1-\nu)}\alpha_T(T_T - T_F)$$

where $\Delta\sigma_T$ is a change in thermoelastic stress in psi; E is the Young's Modulus in psi; $\nu$ is Poisson's Ratio in dimensionless units; $\alpha_T$ is a coefficient of thermal expansion in 1/° F.; $T_T$ is the treatment fluid temperature in ° F.; and $T_F$ is the formation temperature in ° F.

The present disclosure includes a method of increasing hydrocarbon recovery from a tight hydrocarbon formation by generating fractures in a tight hydrocarbon formation by creating a plurality of oriented cavities substantially perpendicular to a horizontal portion of a wellbore, where the oriented cavities extend radially outward from the horizontal portion of the wellbore an approximate distance equal to or greater than one and a half times the wellbore diameter. The method further includes injecting a thermally controlled fluid into the wellbore, where the temperature of the thermally controlled fluid is selected to alter the temperature of the tight hydrocarbon formation, and then fracturing the tight hydrocarbon formation by generating a plurality of planar fractures.

In an embodiment, the method further includes the step of creating a plurality of oriented cavities where the creation of the plurality of oriented cavities is achieved through tools selected from the group consisting of: drills, lasers, perforating guns, hydro-jetting tools, and combinations of the same.

The present disclosure includes a method of stimulating a hydrocarbon reservoir, the method including the steps of inserting a scouring tool into a wellbore, where the wellbore has a vertical portion and a horizontal portion, and where the wellbore is produced in a tight hydrocarbon formation. The tight hydrocarbon formation has a Young's modulus within a range of 6 and 10 Mpsi and a stress gradient in a range of about 0.8 to about 1.40 psi/ft. The tight hydrocarbon formation also has a formation temperature. The method further includes the step of scouring a plurality of oriented cavities in the horizontal portion of the wellbore using the scouring tool, where the oriented cavities are positioned such that they are substantially perpendicular to the horizontal portion of the wellbore, and the oriented cavities extend radially outward from the horizontal portion of the wellbore a predetermined distance to overcome near-wellbore stresses. The method further includes the step of cooling the tight hydrocarbon formation by injecting a thermally controlled fluid into the wellbore for an injection time period, where the temperature of the thermally controlled fluid is substantially lower than the formation temperature, and where the injection time period is as long as is necessary to reduce stresses in the tight hydrocarbon formation as determined by the reservoir properties. The method further includes the steps of injecting a fracturing fluid into the wellbore, and fracturing the tight hydrocarbon formation with the fracturing fluid generating a plurality of fractures.

In an embodiment, the scouring tool is selected from the group consisting of: drills, lasers, perforating guns, hydro-jetting tools, and combinations of the same.

The present disclosure includes a method of increasing hydrocarbon recovery from a tight hydrocarbon formation, the method including the step of creating a plurality of discoidal grooves that extend radially outward from a horizontal portion of the wellbore, where the wellbore is provided in the tight hydrocarbon formation. The discoidal grooves encircle the horizontal portion of the wellbore in a 360° circle. The method further includes the steps of injecting a thermally controlled fluid into the wellbore, where the temperature of the thermally controlled fluid is selected to alter the temperature of the tight hydrocarbon formation; and fracturing the tight hydrocarbon formation by generating a plurality of planar fractures in the direction of the discoidal grooves.

In an embodiment, the method includes the step of creating a plurality of discoidal grooves using a tool selected from the group consisting of: a hydro-jetting tool, a circular notching tool, a downhole rotating turbine, a motorized rotator, and combinations of the same.

In an embodiment, the method further includes the step of fracturing with a fracturing fluid, where the fracturing fluid is the same as the thermally controlled fluid. In an embodiment, the method further includes the step of removing debris from the discoidal grooves created from the creation of the discoidal grooves and transporting the debris into the wellbore.

In an embodiment, the planar fractures are oriented transverse to the wellbore. In an embodiment, the planar fractures are oriented along the direction of maximum horizontal stress.

In an embodiment, the wellbore has a wellbore diameter, and the discoidal grooves extend radially into the tight hydrocarbon formation a distance of at least approximately one and a half times the wellbore diameter so that the planar fractures form transverse to the horizontal portion of the wellbore.

In an embodiment, the method further includes the steps of injecting a hydro-jetting fluid into the wellbore, the hydro-jetting fluid comprising an erosive material and water, and then creating one or more jets of the hydro-jetting fluid in the horizontal portion of the wellbore to create the discoidal grooves. In an embodiment, the erosive material includes sand. In an embodiment, the erosive material includes acid or base.

In an embodiment, the method further includes the step of introducing a proppant to the planar fractures. In an embodiment, the method does not include isolating the horizontal wellbore before the step of fracturing the tight hydrocarbon formation, such that the isolation of the horizontal wellbore by use of packers or isolating devices is not required before the step of fracturing the tight hydrocarbon formation.

In an embodiment, the fracturing fluid is the same as the thermally controlled fluid and the hydro-jetting fluid. In an embodiment, the temperature of the tight hydrocarbon formation is in the range of about 200° F. to 350° F. In an embodiment, the temperature of the thermally controlled fluid is between about −60° F. to 40° F.

In an embodiment, the method further includes calculating a current breakdown pressure of the tight hydrocarbon formation using a breakdown pressure formula populated with characteristics of the tight hydrocarbon formation, where the breakdown pressure formula is $$P_b = \frac{3\sigma_h - \sigma_H + T_0 - 2\eta P_0}{2(1-\eta)}$$

where $P_b$ is the current breakdown pressure in psi; $\sigma_h$ is a minimum horizontal in-situ stress in psi; $\sigma_H$ is a maximum horizontal in-situ stress in psi; $T_0$ is a tensile strength in psi; $P_0$ is a pore pressure in psi; and $\eta$ is a poroelastic parameter in the range of 0 to 0.5. The method further includes calculating a required reduction in the current breakdown pressure such that the tight gas reservoir formation has a final breakdown pressure of below 10,000 psi, or less than 8,000 psi, or less than 6,000 psi, and calculating a treatment fluid temperature required to meet the required reduction in the current breakdown pressure by using the formula $$\Delta\sigma_T = \frac{E}{(1-\nu)}\alpha_T(T_T - T_F)$$

where $\Delta\sigma_T$ is a change in thermoelastic stress in psi; E is the Young's Modulus in psi; $\nu$ is Poisson's Ratio in dimensionless units; $\alpha_T$ is a coefficient of thermal expansion in 1/° F.; $T_T$ is the treatment fluid temperature in ° F.; and $T_F$ is the formation temperature in ° F.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

Figure 1:
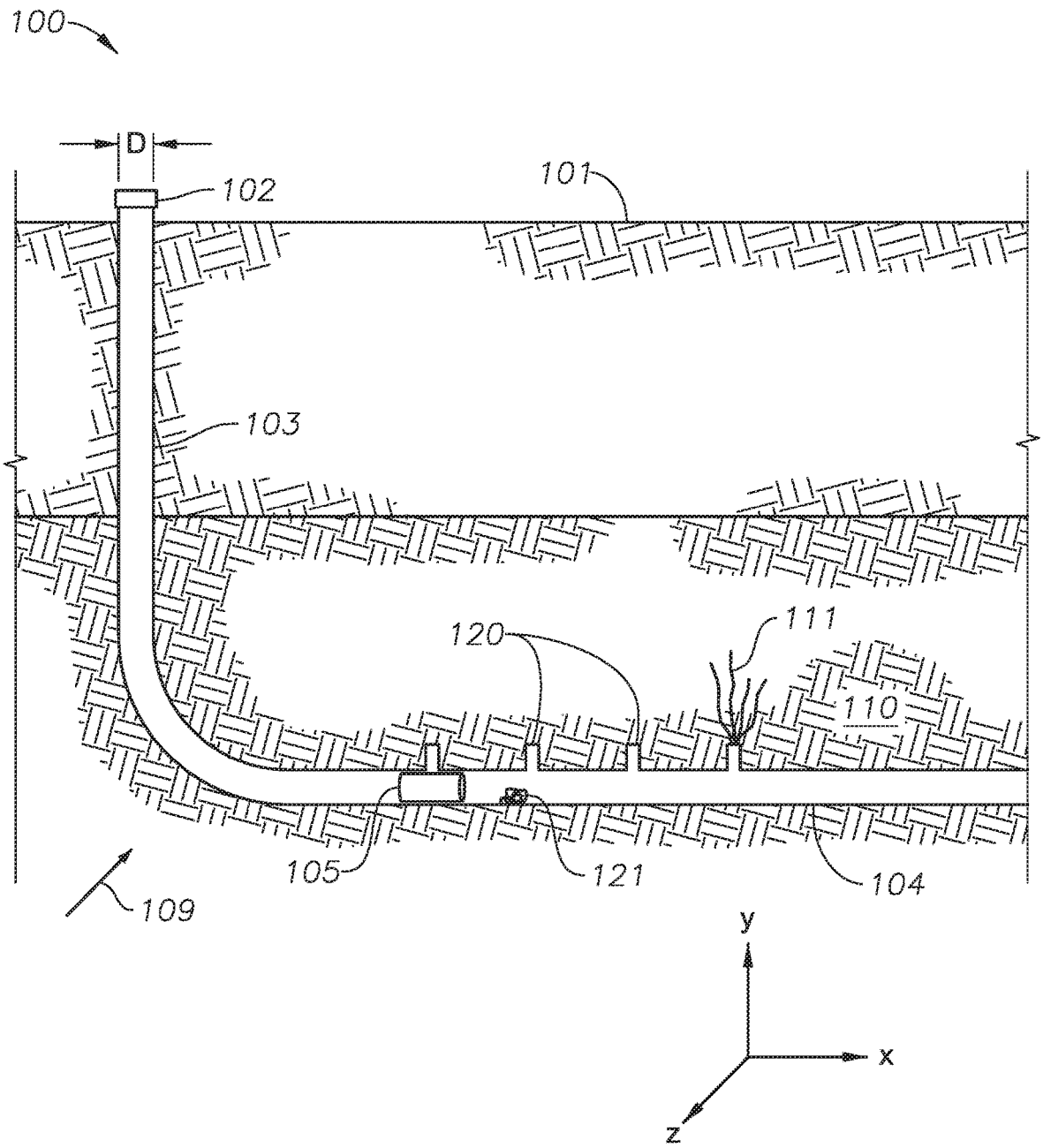
FIG. 1 is a diagram of one example of a hydrocarbon recovery system in a tight gas reservoir formation with oriented cavities in the horizontal portion of the wellbore.

So that the manner in which the features and advantages of the embodiments of methods related to generating fractures in tight gas reservoir formations and tight hydrocarbon formations using oriented cavities and thermally controlled fluid injection, as well as others which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Reservoirs that exhibit fracturing difficulties caused, in part, by high breakdown pressure, and thus can benefit from the technologies disclosed here, include tight gas reservoir formations located in the southern part of Saudi Arabia. These reservoirs can be gas or oil containing reservoirs. Other reservoirs that can benefit from the technology are tight hydrocarbon formations and include generally overpressured, deep, competent rocks with a high Young's modulus of 6-10 mega pounds per square inch (Mpsi) and high minimum stress gradients in the range of 0.8-1.4 pounds per square inch per foot (psi/ft). Many low permeability reservoirs made of sandstone have been developed for oil and gas production in the past, but significant quantities of gas are also produced from low permeability carbonates, shales, and coal seams. These low permeability carbonates, shales, and coal seams can benefit from the technology disclosed herein.

In this disclosure, a tight gas reservoir formation or a tight hydrocarbon formation can refer to a formation with a high Young's modulus of about 6-10 Mpsi and high minimum stress gradients in the range of about 0.8-0.10 psi/ft. Tight gas reservoir formations and tight hydrocarbon formations can include those formations having less than 1.0 millidarcy (mD) matrix permeability and less than 10% matrix porosity. These characteristics can be found in a variety of formations including sandstone and carbonate formations.

The technology disclosed herein can be useful in other types of reservoirs as well, as lower breakdown pressures are not necessarily directly related to lower minimum stress values, and other geo-mechanical properties and near-wellbore stress effects can contribute to the breakdown gradient. The technology disclosed here is also suitable for reservoirs with other ranges of Young's modulus and minimum stress gradients. Many tight hydrocarbon formations exhibit areal heterogeneity in terms of petrophysical and geo-mechanical properties which can lead to unexpectedly higher treating pressures. Geological structures such as proximity to faults can have an impact on the local breakdown pressure. Reservoir characteristics that can indicate a high break pressure include limited permeability. Another reservoir characteristic that can indicate a high breakdown pressure is the reservoir temperature. Reservoirs with high breakdown pressures can have reservoir temperatures in the range of 200° F. to 350° F., or alternatively 250° F. to 300° F., or alternatively 275° F. to 300° F. It is generally anticipated that high reservoir temperatures will lead to high formation rock expansion which will increase the breakdown pressure. The effect of temperature on a reservoir is illustrated by the following equation regarding injection of thermally treated fluid, shown in Formula 2:

$$\Delta\sigma_T = \frac{E}{(1-\nu)}\alpha_T(T_T - T_F). \qquad \text{FORMULA 2}$$

In Formula 2, $\Delta\sigma_T$ is the change in thermoelastic stress in psi; E is the Young's Modulus in psi; ν is Poisson's Ratio in dimensionless units; $\alpha_T$ is the coefficient of thermal expansion in 1° F.; $T_T$ is the treatment fluid temperature in ° F.; and $T_F$ is the formation temperature in ° F.

Formula 2 illustrates that breakdown performance varies in different formations when only temperature is considered. Generally, the coefficient of thermal expansion of sandstone is higher than that of carbonates. The previous reservoir characteristics should not be used as a standalone indicator of high formation breakdown, however. The technology disclosed herein provides benefits including reducing the high breakdown pressure under varying conditions.

Methods disclosed herein can be used in any formation with high breakdown pressures. Difficult reservoir conditions, including the high minimum stress gradients, make fracturing stimulation operations challenging because of high treating pressures required, which many times approach the completion tubular pressure limits. For example, if the downhole tubular and surface equipment are rated to 10,000 psi equivalent, the actual treating pressures in tight hydrocarbon formations can exceed this limit. If the pressure rating of the tubulars is exceeded, catastrophic failure and harm to people, property, and the environment can ensue. Either the stimulation must be performed within the safety margins of the equipment, leading to poor recovery, or the equipment must be upgraded to withstand 15,000 psi. The technology disclosed herein can provide solutions to reduce the required treating pressure up to 4,000 psi or more. The amount of reduction in the required treating pressure depends on the reservoir and geo-mechanical properties, reservoir temperature, and the temperature of the injected fluids.

Even if initial breakthrough is achieved in tight formations, some formations can still not exhibit sufficient permeability to provide sufficient injection rates to propagate fracturing fluids and proppant into the tight formations. These formations include tight-gas sandstone, tight-gas carbonates, tight-gas shales, and coal bed methane formations. In these types of tight formations where initial fracture formation can occur, the method disclosed here is advantageous for propagating fractures.

Disclosed embodiments exemplify high-pressure jetting technology, an oriented cavity or discoidal groove artificially created in a horizontal well, and the injection of thermally controlled fluids to lower breakdown pressures and allow for the initiation of fractures in formations previously unable to be fractured due to high breakdown pressure. Once the injection path is created by the cavity or groove, the thermally charged fluids can begin to lower formation stresses, break up the rock, and develop an artificial network of fractures. The injection of a thermally controlled fluid for sufficient time reduces formation stresses. Disclosed methods lower the breakdown pressure and allow for the successful fracturing of tight formations by initiating one or more fractures, propagating the one or more fractures, and developing the necessary conduits and complexity to deliver hydrocarbons at an increased rate from the hydraulic fracturing treatment.

Without being bound by any theory or practice, it is believed that the penetration of the oriented cavities or discoidal grooves in the tight gas reservoir formation overcomes additional near-wellbore stresses and allows thermally controlled fluid to effectively lower the in-situ stresses of the reservoir to lower breakdown pressure and allow for additional cracking. Formula 2 can be used to quantify the minimum horizontal stress reduction due to temperature effects. For example, a sandstone reservoir with a temperature of 300° F., a Young's Modulus of 6 Mpsi, a Poisson's ratio of 0.2, and a thermal expansion coefficient of 0.000005 1/° F. would have a stress reduction of 1,000 psi if there is a 40° F. difference in temperature between the treatment fluid temperature and the formation temperature, and a stress reduction of 4,500 psi if there is a 120° F. temperature difference.

Without oriented cavities or discoidal grooves penetrating the reservoir and passing through near-wellbore high stress areas, the thermally controlled fluid can reduce certain in-situ stresses, but not sufficiently to overcome additional stresses generated in the near-wellbore area, making the breakdown pressure still too high for successful fracturing. Creation of a near-wellbore skin during drilling and completion leads to a new stress state which can further increase pressures required for fracture initiation. The puncture of the near-wellbore skin by the oriented cavities or discoidal grooves weakens the rock and helps address this issue. The use of either oriented cavities or discoidal grooves not only reduce near-wellbore high stress areas but also ensure that the thermally controlled fluids penetrate the formation to further decrease the temperature and the in-situ stresses. Unexpected and surprising reductions in required hydraulic fracturing fluid pressures result from the synergistic combination of oriented cavities and/or discoidal grooves applied with thermally controlled fluids due in part to reduction of breakdown pressures and near-wellbore stresses. Bypassing the near wellbore stress field and allowing the fracture to initiate through the oriented cavity along the vertical hole and in the direction of maximum horizontal stress coupled with thermal effects allows for a drop in the fracture initiation pressure in excess of 20% as compared to cases where these actions are not taken.

Hydro-jetting advantageously disposes one or more oriented cavity or one or more discoidal groove that is a clean and unstressed perforation, which does not pulverize or compact the formation. Additionally, all of the debris created by the hydro-jetting can be carried away out of the oriented cavity or discoidal groove. Debris left in the perforations from conventional perforating can lead to fracture face re-orientation. In fracture face re-orientation, as the hydraulic fractures grow, the fractures no longer confine themselves to the fracture plane and instead re-orient themselves along a non-planar geometry. Because debris are removed from the cavity or groove with hydro-jetting, fracture face re-orientation is unlikely to occur. In an embodiment, the process of initiating fracturing of a hydrocarbon formation takes place generally by initiating a series of cavities or grooves in a wellbore via hydro-jetting, introducing a thermally controlled fluid into the wellbore, and fracturing the formation.

Referring to FIG. 1, a diagram is provided as an example of a hydrocarbon recovery system using the novel method of fracturing a formation using oriented cavities and injection of a thermally controlled fluid. In a hydrocarbon recovery system 100 the wellbore 102 is drilled in the tight gas reservoir formation 110. The tight gas reservoir formation 110 can be of the type located in the southern part of Saudi Arabia, Oman, Algeria, Australia, the UAE, or any other part of the world that can exhibit over-pressured, deep, very competent rocks. Over-pressured reservoirs are those above hydrostatic pore-pressure gradients. Deep reservoirs are those generally deeper than 12,000 ft. Competent rocks are those generally having a Young's Modular greater than about 6.0 Mpsi. The tight gas reservoir formation 110 can exhibit a Young's modulus in the range of about 6-10 Mpsi and minimum stress gradients in the range of about 0.8-1.4 psi/ft. The tight gas reservoir formation 110 can be any formation with a high breakdown pressure. The tight gas reservoir formation 110 has a formation maximum horizontal stress 109, which can be in any direction on the x-z plane. In FIG. 1, the formation maximum horizontal stress 109 is directed along the z axis.

The wellbore 102 generally proceeds from surface 101 into tight gas reservoir formation 110. The wellbore 102 can be an open-hole recovery well, a cased-hole recovery well, or any other well generally known in the art. The wellbore 102 includes the vertical portion 103 and the horizontal portion 104, and has a wellbore diameter D. The vertical portion 103 includes substantially vertical portions, wherein the vertical portion is within 15° of being perpendicular to the surface 101. The horizontal portion 104 includes substantially horizontal portions, wherein the horizontal portion is within 15° of being perpendicular to the vertical portion 103 of the wellbore 102. The wellbore 102, the vertical portion 103, and the horizontal portion 104 can be formed by any method known in the art. Wellbore diameter D can be the same or vary between the vertical portion 103 and the horizontal portion 104.

One or more oriented cavities 120 are formed radially outward in the horizontal portion 104 of the wellbore 102. The oriented cavities 120 can be formed substantially perpendicular to the horizontal portion 104 of the wellbore 102. The term "substantially perpendicular" refers to deviating less than about 15° from perpendicular alignment with regard to the spatial orientation of two objects. In an embodiment, the oriented cavity 120 is substantially parallel to the vertical portion 103 of the wellbore 102. The term "substantially parallel" refers to deviating less than about 15° from parallel alignment with regard to the spatial orientation of two objects. In other embodiments, the oriented cavity 120 is in any direction substantially perpendicular to the horizontal portion 104 of the wellbore 102. The penetration of the oriented cavities 120 bypasses the near-wellbore skin. In an embodiment, the oriented cavities 120 extend radially outward from the horizontal portion 104 of the wellbore 102 at an approximate distance equal to or greater than one and a half times the wellbore diameter D; the distance, at least 1.5D, of the oriented cavity 120 being considered from the initiation point of the oriented cavity 120 at an outer wall of the wellbore 102 and extending into tight gas reservoir formation 110. In other embodiments, the oriented cavities 120 extend radially outward from the outer radius of the horizontal portion 104 of the wellbore 102 at an approximate distance equal to 1 foot, 1.5 feet, 2 feet, 2.5 feet, or 3 feet.

In an alternative embodiment, the orientated cavities 120 extend radially outward from the horizontal portion 104 of the wellbore 102 a distance great enough to overcome near-wellbore skin and stresses. Generally speaking, the further the oriented cavities 120 extend into the tight gas reservoir formation 110, the more the stress influences from the horizontal portion 104 of the wellbore 102 are reduced. These influences include how the horizontal portion 104 of the wellbore 102 affects the stress state of the near-wellbore area in the formation surrounding the oriented cavities 120 during fracturing. If the oriented cavities 120 extend a distance of three times the diameter of the horizontal portion 104 of the wellbore 102 into the tight gas reservoir formation 110, the influences from the horizontal portion 104 of the wellbore 102, including near wellbore stresses, become negligible. The oriented cavities 120 extending a distance of less than three times the diameter of the horizontal portion 104 of the wellbore 102 into the tight gas reservoir formation 110 can still form transverse fractures and can still overcome near-wellbore stresses. In an embodiment, the near-wellbore stresses are overcome when the oriented cavity 120 extends a distance of at least one and a half times the wellbore diameter D into the tight gas reservoir formation 110 from the outer radius of the horizontal portion 104 of the wellbore 102. In an embodiment, the oriented cavity 120 has any diameter. In another embodiment, the oriented cavity 120 has a diameter of at least approximately 2 inches. The oriented cavity 120 can be formed by any method known in the art. The oriented cavity 120 can be formed by hydro-jetting. The hydro-jetting can be performed by any method known in the art.

To perform hydro-jetting, the hydro-jetting fluid can be injected into the wellbore 102. The hydro-jetting fluid can comprise a mixture of an abrasive material and water, and can be at any temperature. In an embodiment, the abrasive material is sand. In an embodiment, the hydro-jetting fluid includes a mixture of an erosive material and water. In an embodiment, the erosive material is sand. In an embodiment, the erosive material is acid. The acid can be hydrochloric acid, acetic acid, or any other acid with a pH less than 6.5. In general, the hydro-jetting fluid needs to be compatible with the formation. Any hydro-jetting fluid can be used, including aqueous solutions of potassium chloride liquids or other brines. In some embodiments, the hydro-jetting fluid is the same as the hydraulic fracturing fluid. In other embodiments, the hydro-jetting fluid is not a hydraulic fracturing fluid. In some embodiments, the hydro-jetting fluid does not include viscosifying agents, viscous components, proppants, or binders. The hydro-jetting fluid can be introduced into the wellbore 102 by any method known in the art. The hydro-jetting fluid can be directed through a downhole tool 105. Any downhole tool capable of performing hydro-jetting can be used.

The hydro-jetting disclosed herein has a guaranteed deeper penetration compared to conventional hydro-jetting. In an embodiment, the hydro-jetting fluid pressure is increased to approximately 2000 pounds per square inch (psi) to perform hydro-jetting inside the horizontal portion 104 of the wellbore 102. In an embodiment, the pressure of the hydro-jetting fluid is approximately in the range of 500 psi to 5,000 psi, or alternatively in the range of 500 psi to 2,250 psi, or alternatively in the range of 1,000 psi to 5,000 psi, or alternatively in the range of 1,000 psi to 2,000 psi, or alternatively in the range of 2,000 psi to 5,000 psi, or alternatively in the range of 1,500 psi to 2,250 psi. The hydro-jetting fluid can be at the same temperature as the thermally controlled fluid. In an embodiment, the hydro-jetting fluid is at a different temperature than the thermally controlled fluid. The hydro-jetting fluid can be at the same temperature or at a different temperature than the tight gas reservoir formation. The hydro-jetting advantageously does not pulverize and compact the formation, and creates an oriented cavity 120 that is clean and unstressed. In an embodiment, debris 121 created by the hydro-jetting are carried away from inside the oriented cavity 120 through horizontal portion 104 and out of vertical portion 103, for example out through an annulus between wellbore 102 and downhole tool 105 (not pictured).

In an embodiment, the oriented cavities 120 are formed mechanically, such as by drilling into the tight gas reservoir formation 110. In an embodiment, the oriented cavities 120 are formed by lasers. In an embodiment, the oriented cavities 120 are formed by perforations. The formation of the oriented cavities 120 without traditional perforation methods are preferred, though, as the oriented cavities 120 formed without perforations have a better defined shape with less damage to the tight gas reservoir formation 110. The damages caused by perforations can generate leak-off paths for the fluid, reducing the effective pressure exerted in the formation to form the fractures 111 therein, which causes an increase in the breakdown pressure required to fracture the tight gas reservoir formation 110. The Oriented Hydrajet Fracturing tool from Halliburton, or the Radial Drilling Tool from Radial Drilling Technologies are tools that can be used to form the cavities for this purpose.

After one or many oriented cavities 120 are formed, the thermally controlled fluid is injected into the wellbore 102 at an initial pressure and introduced into the oriented cavities 120 of the horizontal portion 104 of the wellbore 102. In general, the thermally controlled fluid used should be compatible with the formation. Any thermally controlled fluid can be used, including gases, such as $N_2$ and $CO_2$, and liquids, such as aqueous solutions of potassium chloride and other brines or liquid $CO_2$. In an embodiment, the thermally controlled fluid is the same fluid as the fracturing fluid. In some embodiments, the thermally controlled fluid is not a hydraulic fracturing fluid. In some embodiments, the thermally controlled fluid does not include viscosifying agents, viscous components, proppants, or binders. In an embodiment, the thermally controlled fluid is the same as the hydro-jetting fluid. The temperature of the thermally controlled fluid is selected to be a temperature that would alter the temperature of the tight gas reservoir formation 110 once the thermally controlled fluid is injected into the formation.

In some embodiments, the temperature of the thermally controlled fluid is chosen relative to the ambient surface temperature and the temperature of the formation. In an embodiment, the tight gas reservoir formation 110 is at a temperature greater than an ambient temperature at the surface 101 of the wellbore 102, and the thermally controlled fluid is at a temperature at or lower than the ambient temperature at the surface 101. Therefore, in this embodiment, the thermally controlled fluid is kept at a temperature at or lower than the ambient temperature of the surface 101 and injected into the wellbore 102 in the horizontal portion 104 to cool the tight gas reservoir formation 110 near the wellbore 102. In another embodiment, the tight gas reservoir formation 110 is at a temperature lower than an ambient temperature at the surface 101 of the wellbore 102, and the thermally controlled fluid is at a temperature at or higher than the ambient temperature of the surface 101. Therefore, in this embodiment, the thermally controlled fluid is kept at a temperature at or above the ambient temperature of the surface 101 and injected into the wellbore 102 in the horizontal portion 104 to heat the tight gas reservoir formation 110 near the wellbore 102.

In yet other embodiments, the temperature of the thermally controlled fluid is chosen based on the temperature of the tight gas reservoir formation 110. In an embodiment, the temperature of the thermally controlled fluid is substantially lower than the temperature of the tight gas reservoir formation 110 in order to cool the formation. In an embodiment, the temperature of the thermally controlled fluid is at least about 100° F. less than the temperature of the tight gas reservoir formation 110, or alternately at least about 200° F. less, or alternately at least about 300° F. less. In another embodiment, the temperature of the thermally controlled fluid is greater than the temperature of the tight gas reservoir formation 110 in order to heat the formation. In an embodiment, the temperature of the thermally controlled fluid is at least about 100° F. greater than the temperature of the tight gas reservoir formation 110, or alternately at least about 200° F. greater, or alternately at least about 300° F. greater. In an embodiment, the thermally controlled fluid includes steam at a temperature higher than the temperature of the tight gas reservoir formation 110. Formula 2 can be used to calculate and determine the temperature difference required to provide a specific in-situ stress reduction when values for mechanical and thermal properties of the reservoir are known or can be assumed. In some embodiments, the thermally controlled fluid has a temperature range of about −60° F. to 40° F. In some embodiments, alternating hot and cold thermally controlled fluids can be injected at alternating intervals to induce temperature change shocks to reduce breakdown pressures and optionally generate fractures.

One purpose of the thermally controlled fluid is to induce thermal reduction of the in-situ stresses of the tight gas reservoir formation 110. In an embodiment, the reduction of the stresses in the reservoir is achieved by holding the thermally controlled fluid in the horizontal portion 104 of the wellbore 102 for a sufficient time to cool or heat the reservoir. The variation in the temperature between the fluid and the reservoir causes the in-situ stress to reduce as shown in Formula 2. In some embodiments, the injection of the thermally controlled fluid initiates the formation of fractures 111. In some embodiments, low-temperature fluids used in such applications cause instability in the formation with respect to tensile failure, and increased stress intensity at the fracture tip leading to fracture growth. Deeper penetration of the thermally controlled fluids into the reservoir and the reservoir exposure time are factors considered to induce thermal reduction of the in-situ stresses.

Modeling and simulation can be performed to determine the requirements of the thermally controlled fluid injection process. The required exposure time for the thermally controlled fluid depends on factors such as the thermally controlled fluid volume, the thermally controlled fluid temperature, and reservoir properties, including the rock type, formation composition, the thermal and petrophysical characteristics of the rock, in-situ stresses, and the geomechanical and geophysical properties of the formation. Advanced numerical model simulators can take the above factors into consideration to determine the required exposure time. In an embodiment, the method includes the determination, via modeling or simulation, of an amount of time that thermally controlled fluid would need to be injected into the wellbore 102 to change the temperature of the tight gas reservoir formation 110 closest to the horizontal portion 104 of the wellbore 102 in order to reduce the stresses of the tight gas reservoir formation 110 closest to the horizontal portion 104 of the wellbore 102, and then continuing to inject the thermally controlled fluid into the wellbore 102 for that amount of time, optionally allowing the fluid to sit for a period of time, or allowing for continuous injection and return via the use of a return annulus. For example, concentric coiled tubing can be applied in some embodiments for application of the thermally controlled fluid and its return.

Figure 4:
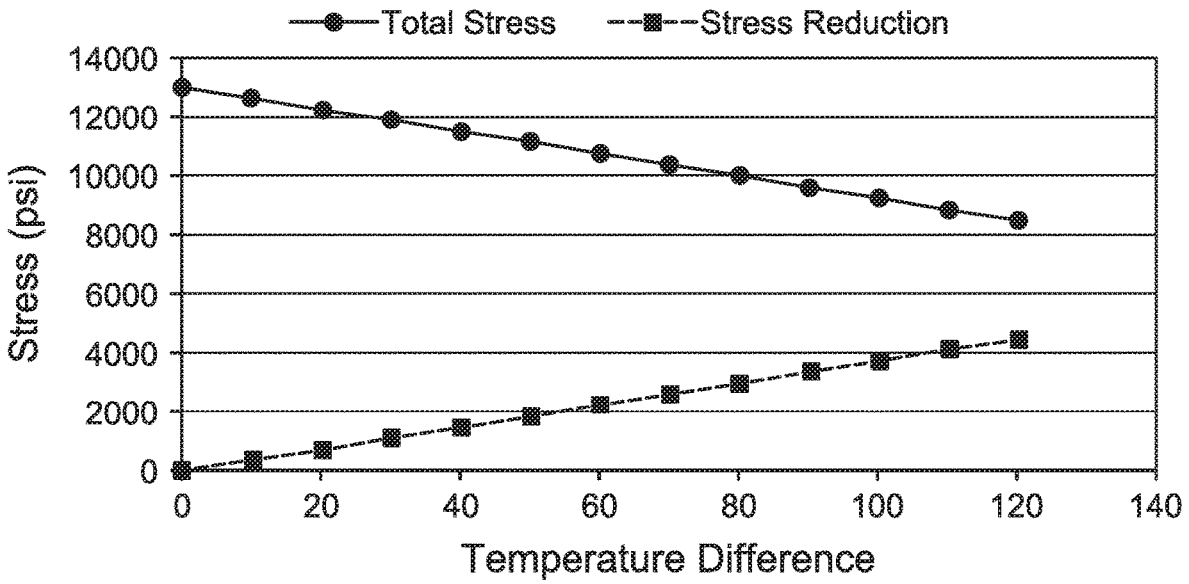
FIG. 4 is a graph of modeling simulation results showing decreased breakdown pressures required for fracturing when formation temperature is modified with a thermally controlled fluid.

The volume of the fluid and the amount of time the fluid must be held in the formation can be based on reservoir, mechanical, and thermal properties, among others. A reservoir cooldown analysis can be performed to determine the amount of cooling needed to reduce the reservoir stresses. If the reservoir temperature, in-situ stresses, rock mechanical properties, and thermal properties are known, then the amount of cooling and temperature reduction required to reduce the reservoir stress by a specific amount can be quantified by using Formula 2. FIG. 4 shows an example graph of total stress reduction for an example sandstone reservoir with a reservoir temperature of 300° F., a Young's Modulus of 6 Mpsi, a Poisson's ratio of 0.2, and a thermal expansion coefficient of 0.000005 1/° F.

The temperature of the thermally controlled fluid can be altered via any method known in the art. In an embodiment, cooling systems, heat exchangers, or heaters on the surface 101 are used to alter the temperature of the thermally controlled fluid.

The penetration of the oriented cavities 120 in the tight gas reservoir formation 110 overcomes additional near-wellbore stresses, also allowing the thermally controlled fluid to effectively lower the in-situ stresses of the reservoir resulting in lower breakdown pressures and allowing for additional fracturing. Without the oriented cavities 120 penetrating the reservoir and bypassing the near-wellbore greater stress area, the thermally controlled fluid would reduce the in-situ stresses, but possibly not enough to overcome the additional stresses generated in the near-wellbore area, which can result in the breakdown pressures still being too great compared to the tubular completion limits. Creation of a near-wellbore skin during drilling and completion leads to a new stress state which can further increase fracture initiation. The puncture of the near-wellbore skin by the oriented cavities addresses this issue. The deeper penetration of the cavity 120 is independent of stress direction and bypasses near-wellbore skin, which eliminates fracture tortuosity and improves fracture deliverability.

The oriented cavities 120 can, with an appropriate length as disclosed herein, replicate a "short" vertical well. Generally, in the fracturing of a vertical well, longitudinal fractures are more readily formed at lower pressure because of the stress state in the subterranean zone. Fractures generally propagate perpendicular to the minimum principal stress in the subterranean zone. Generally, the minimum principal stress is oriented horizontally; therefore, for a vertical wellbore, longitudinal fractures are more likely to form, and form at lower breakdown pressures. Therefore, the oriented cavities 120 in the horizontal portion 104 of the wellbore 102 serve as an initiation point for fractures 111, which can be longitudinal fractures, with respect to the oriented cavities 120. The fractures 111 propagate radially outwardly from the horizontal portion 104 of the wellbore 102 and oriented cavity 120, perpendicular to the minimum principal stress of the subterranean zone (x,z). The deeper penetration of the oriented cavity 120 into the tight gas reservoir formation 110 synergistically decreases the pressure needed to initiate the fractures 111 in addition to the stress reduction obtained from cooling the reservoir.

The method then contemplates fracturing of the tight gas reservoir formation 110, and generating fractures 111. During hydraulic fracturing operations, a fluid is pumped under a pressure and rate sufficient for cracking the reservoir formation and creating fractures. Fracturing can be performed by any method generally known in the art. The disclosed use of the oriented cavities 120 and the injection of the thermally controlled fluids lowers the breakdown pressure of the formation and results in fracturing the formation at lower pressures. In an embodiment, the injection of the thermally controlled fluid initiates the formation of fractures 111, which are further propagated by hydraulic fracturing. The fractures 111 can be generated in a planar configuration. In an embodiment, fracturing is performed while isolating portions of the wellbore 102. In an embodiment, fracturing is performed without isolation of portions of the wellbore 102. Any suitable fracturing fluid can be used to perform fracturing, for example oil-based or water-based fluids with or without proppants. In an embodiment, the fracturing fluid is the same as the thermally controlled fluid. In an embodiment, the fracturing fluid is the same as the hydro-jetting fluid. In an embodiment, the fracturing fluid is different from the thermally controlled fluid. In an embodiment, the fracturing fluid is different from the hydro-jetting fluid.

The fractures 111 initiate in the tight gas reservoir formation 110. The oriented cavity 120 provides a cavity similar to a weakened wellbore and promotes the creation a planar hydraulic fracture configuration (described further with respect to FIG. 2). A minimum of one and a half wellbore diameter deep oriented cavities 120 assist in ensuring transverse fracture initiations.

The fractures 111 can be initiated along the weakest point in the oriented cavity 120 itself. The cavity 120 can be blocked with debris 121 if explosive perforating technology is used. Explosive perforating technology can create a tapering of the oriented cavity 120, where the oriented cavity 120 narrows as it extends from the entry hole at the horizontal portion 104 of the wellbore 102 to the tip of the oriented cavity 120 in the tight gas reservoir formation 110. The explosive perforating technology can pulverize the formation surrounding the oriented cavity 120 and can compact the rock and debris inside the oriented cavity 120. The pulverized formation surrounding the oriented cavity 120 exists in an elevated stress state, such that when hydraulic pressure is applied, fracture face re-orientation can occur. In fracture face re-orientation, as the hydraulic fractures grow, the fractures no longer confine themselves to the fracture plane and instead re-orient themselves along a non-planar geometry. Fracture face re-orientation can be less likely to occur when the oriented cavity 120 has a reduced stress state due to hydro-jetting because hydro-jetting scours the formation rather than compacting it, does not leave the formation around the oriented cavity 120 in a stressed state, and removes debris 121 from the oriented cavity 120.

In another embodiment, the fractures 111 are generated generally in a direction of the formation maximum horizontal stress 109 of the tight gas reservoir formation 110. The direction of the formation maximum horizontal stress 109 can be in any direction along the x-z plane. In an embodiment, the plurality of planar fractures 111 is generated transverse to the horizontal portion 104 of the wellbore 102. In an embodiment, the plurality of planar fractures 111 is generated transverse to the vertical portion 103 of the wellbore 102. In an embodiment, the plurality of planar fractures 111 is generated transverse to the oriented cavity 120.

Once the planar fractures 111 are generated, additional methods of increasing hydrocarbon recovery can occur. In an embodiment, proppant is introduced into the fractures 111. Any type of proppant can be used, such as sand, glass, or organic matter.

Figure 2:
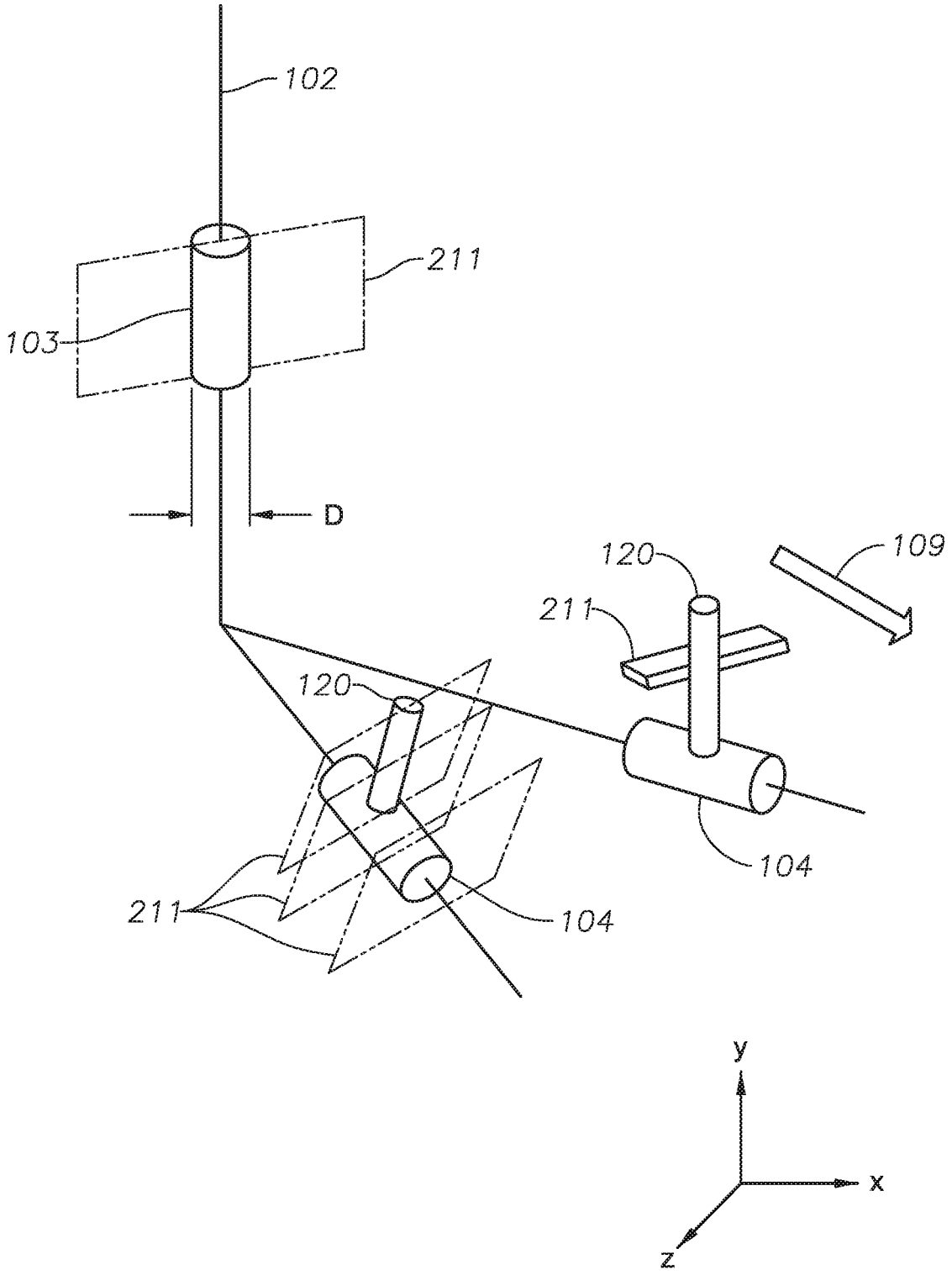
FIG. 2 is a diagram of longitudinal fractures compared to fracture planes generated using oriented cavities.

Referring to FIG. 2, a variety of configurations of the fracture planes 211 created with the methods disclosed herein are shown. A wellbore 102 is shown with a vertical portion 103 and a plurality of horizontal portions 104.

Referring to the two horizontal portions 104 of the wellbore 102 on the rightmost portion of FIG. 2, the series of fracture planes 211 are shown which illustrate the general area of the formation of the fractures 111, where the arrangement of the fractures 111 generally conform with the fracture planes 211. In an embodiment, the oriented cavity 120 formed in the horizontal portion 104 of the wellbore 102 in combination with the injection of the thermally controlled fluids allows for the generation of fracture planes 211 via hydraulic fracturing. In an embodiment, the fracture planes 211 are transverse to the horizontal portion 104 of the wellbore 102. In an embodiment, the fracture planes 211 are generated in the general direction of formation maximum horizontal stress 109, which can be in any direction of the horizontal portion 104 of the wellbore 102. In an embodiment, the fracture planes 211 are not controlled by the direction of the horizontal portion 104 of the wellbore 102 and therefore the fracture planes 211 may become longitudinal, transverse, or oblique to the wellbore 102. Also as shown in FIG. 2, multiple parallel fracture planes 211, optionally non-intersecting, can be created corresponding to multiple oriented cavities 120.

Figure 3:
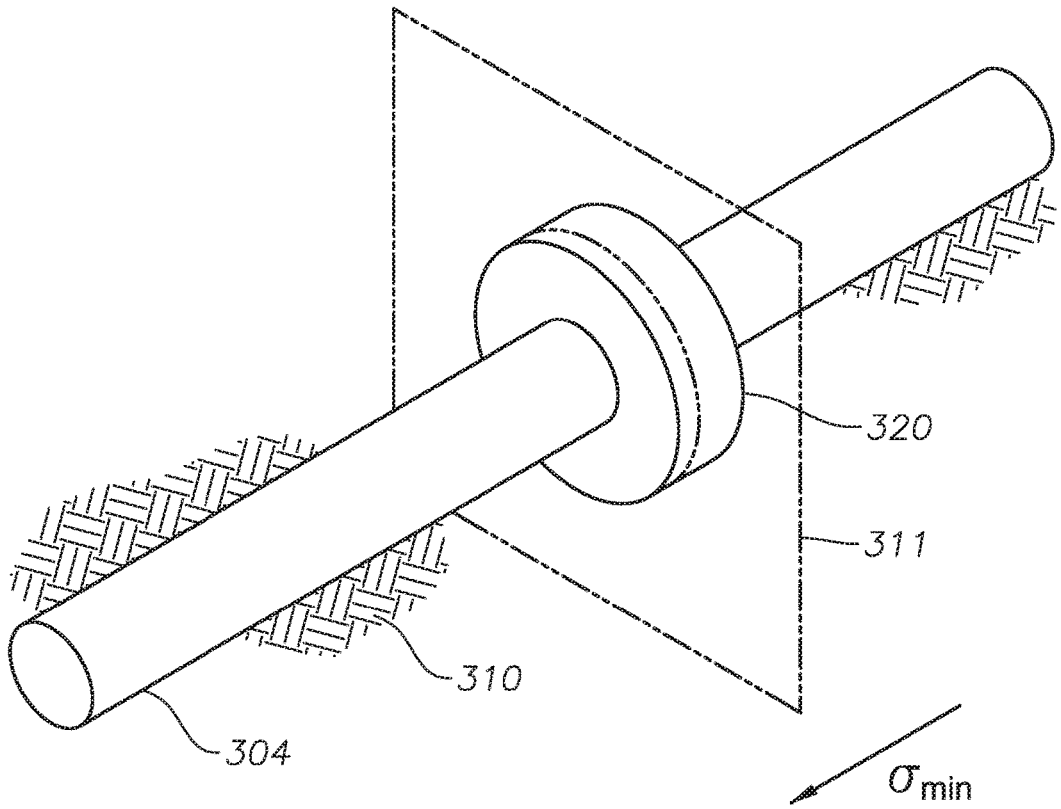
FIG. 3 is a diagram of one example of a hydrocarbon recovery system in a tight gas reservoir formation with a discoidal groove extending from the horizontal portion of the wellbore, where the horizontal portion of the wellbore is extending in the direction of the $\sigma_{min}$ axis.

Referring to FIG. 3, in an alternative embodiment, the discoidal groove 320 is created in the horizontal portion 304 of the wellbore 302 (not shown) formed in the tight hydrocarbon formation 310. The horizontal portion 304 of the wellbore 302 can be drilled in the direction of the minimum in-situ stress (mum axis) to create transverse fractures to the wellbore 302. The discoidal groove 320 takes the form of a groove formed 360° around the center of the horizontal portion 304 of the wellbore 302 extending into the subterranean formation. The radius of the discoidal groove 320 is larger than the radius of the horizontal portion 304 of the wellbore 302 at all points 360° around the discoidal groove 320. In some embodiments, the discoidal groove 320 has a radius that is at least about 1.5, or alternately at least about 2, or alternately at least about 2.5, or alternately at least about 3 times the radius of the horizontal portion 304 wellbore 302. This generates the discoidal groove 320 in the form of a circular notch around the horizontal portion 304 of the wellbore 302. The formation of the discoidal groove 320 in the tight hydrocarbon formation 310 mechanically weakens the rock at that location. Mechanically weak rock requires lower fracturing pressure and will force the hydraulic fracture to initiate at the target depth.

Returning to FIG. 3, the discoidal groove 320 is formed in the horizontal portion 304 of the wellbore 302, and when fracturing of the formation occurs, the fracture planes 311 are generated. In an embodiment, the discoidal groove 320 has a radius or diameter equal to or greater than one and a half times the wellbore radius or diameter in order to ensure lower fracture initiation pressures and transversely oriented fractures. A reduction in fracture initiation pressures to normal breakdown pressures of approximately 25% can be realized if a proper diameter of the discoidal groove 320 is generated.

The discoidal groove 320 can be created by any known method in the art. The discoidal groove 320 can be created by a hydro-jetting tool or a circular notching tool, and can be combined with a downhole rotating turbine or a motorized rotator. In an embodiment, the discoidal groove 320 is created by hydro-jetting. To perform hydro-jetting, the hydro-jetting fluid is injected into the wellbore 302. The hydro-jetting fluid can comprise a mixture of an erosive material and water. In an embodiment, the erosive material is sand. In an embodiment, the erosive material is acid. The acid can be hydrochloric acid, acetic acid, or any other acid with a pH less than 6.5. In a further embodiment, the erosive material is a base. The base can be a hydroxide, or any other base with a pH greater than 7.5. The discoidal groove 320 can be created by a tool typically deployed through coiled tubing or jointed pipe using a high-pressure erosive jetting tool run in conjunction with a downhole turbine that provides a 360° rotation of the specially configured jetting tool to create the discoidal grooves 320 substantially perpendicular to the horizontal portion 304 of the wellbore 302. The downhole turbine can be acid resistant in cases where acid is being used for creating the discoidal grooves 320, especially in carbonate formations. The downhole turbine can be resistant to caustic or base solutions in cases where a base is being used for creating the discoidal grooves 320, especially in sandstone formations. Multiple discoidal grooves can be placed in a wellbore by pulling up the coiled tubing to the next target depth and repeating the rotating jetting at that point. There is no limit to the number of discoidal grooves that can be placed within a wellbore. There can be an optimum number of fractures generated by this method for reservoir drainage.

In an embodiment, after the formation of the discoidal grooves 320, the method further includes the injection of the thermally controlled fluid into the wellbore 302 at an initial pressure and introduced into the discoidal grooves 320 of the horizontal portion 304 of the wellbore 302. The method of injection and use of the thermally controlled fluid, as well as the characteristics and composition of the thermally controlled fluid, can have the same characterization as in other embodiments disclosed herein. The method then contemplates fracturing of the tight hydrocarbon formation 310. The method of fracturing as well as the characteristics and composition of the thermally controlled fluid can have the same characterization as in other embodiments. The hydraulic fracturing can result in fracture planes 311. In an embodiment, the fracture planes 311 are generated transverse to the horizontal portion 304 of the wellbore 302.

Although the present disclosure has been described in detail, it should be understood that various changes, substitutions, and alterations can be made without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise. The terms "about" and "approximately" and the like are utilized in this disclosure to represent the inherent degree of uncertainty that may be attributed to any quantitative comparison, value, measurement, or other representation. The term "about" is also utilized in this disclosure to represent the degree by which a quantitative representation can vary from a stated reference without resulting in a change in the basic function of the subject matter at issue.

The description may use the phrases "in some embodiments," "in an embodiment," or "in embodiments," which can each refer to one or more of the same or different embodiments. Furthermore, the terms "comprising," "including," "containing," and the like, as used with respect to embodiments of the present disclosure, are synonymous.

Ranges may be expressed throughout as from about one particular value, or to about another particular value. When such a range is expressed, it is to be understood that another embodiment is from the one particular value or to the other particular value, along with all combinations within said range.

In the drawings and the specification, there have been disclosed example embodiments of the present disclosure, and although specific terms are employed, the terms are used in a descriptive sense only and not for purposes of limitation. The embodiments of the present disclosure have been described in considerable detail with specific reference to these illustrated embodiments. It will be apparent that various modifications and changes can be made within the spirit and scope of the disclosure as described in the foregoing specification, and such modifications and changes are to be considered equivalents and part of this disclosure.

What is claimed is:

1. A method of increasing hydrocarbon recovery from a tight hydrocarbon formation, the method comprising the steps of:

injecting a hydro-jetting fluid into a wellbore, wherein the wellbore is formed within a tight gas reservoir formation with a vertical portion and a horizontal portion, the horizontal portion having a wellbore diameter, and wherein the hydro-jetting fluid comprises a mixture of an abrasive material and water;

directing the hydro-jetting fluid through a downhole tool at a pressure greater than 2000 psi to effect hydro-jetting inside the horizontal portion of the wellbore;

creating a plurality of oriented cavities substantially perpendicular to the horizontal portion of the wellbore via hydro-jetting, wherein the oriented cavities extend radially outward from the horizontal portion of the wellbore distance equal to or greater than one and a half times the wellbore diameter;

injecting a thermally controlled fluid into the wellbore, wherein the temperature of the thermally controlled fluid is selected to alter the temperature of the tight gas reservoir formation; and fracturing the tight gas reservoir formation by generating a plurality of planar fractures.

2. The method of claim 1, wherein the tight gas reservoir formation has a Young's modulus within a range of about 6 to about 10 Mpsi and a stress gradient in a range of about 0.8 to about 1.40 psi/ft.

3. The method of claim 1, wherein the tight gas reservoir formation is at a temperature greater than an ambient temperature at the surface of the wellbore, and the thermally controlled fluid is at a lower temperature than the tight gas reservoir formation.

4. The method of claim 1, wherein the tight gas reservoir formation is at a temperature lower than an ambient temperature at the surface of the wellbore, and the thermally controlled fluid is at a higher temperature than the tight gas reservoir formation.

5. The method of claim 1, wherein the step of injecting the thermally controlled fluid into the wellbore is carried out after the step of creating the plurality of oriented cavities substantially perpendicular to the horizontal portion of the wellbore via hydro-jetting.

6. The method of claim 1, wherein the plurality of oriented cavities generated substantially perpendicular to the horizontal portion of the wellbore are positioned substantially parallel to the vertical portion of the wellbore.

7. The method of claim 6, wherein the plurality of planar fractures is generated in a direction of maximum horizontal stress of the tight gas reservoir formation.

8. The method of claim 1, wherein the plurality of planar fractures is generated transverse to the horizontal portion of the wellbore.

9. The method of claim 1, further comprising the steps of:

determining an amount of time that the thermally controlled fluid is required to be injected into the wellbore to change the temperature of the tight gas reservoir formation in a near-wellbore area to reduce the stresses of the tight gas reservoir formation in the near-wellbore area via modeling or simulation; and continuing to inject the thermally controlled fluid into the wellbore for the determined amount of time.

10. The method of claim 1, wherein the oriented cavities are at least 2 inches in diameter.

11. A method of increasing hydrocarbon recovery from a tight hydrocarbon formation, the method comprising the steps of:

creating a plurality of oriented cavities substantially perpendicular to a horizontal portion of a wellbore, wherein the wellbore is provided in the tight hydrocarbon formation, further wherein the oriented cavities extend radially outward from the horizontal portion of the wellbore distance about equal to or greater than one and half times the wellbore diameter;

injecting a thermally controlled fluid into the wellbore, wherein the temperature of the thermally controlled fluid is selected to alter the temperature of the tight hydrocarbon formation; and fracturing the tight hydrocarbon formation by generating a plurality of planar fractures.

12. The method of claim 11, wherein the step of creating a plurality of oriented cavities is achieved through at least one tool selected from the group consisting of: drills, lasers, perforating guns, hydro-jetting tools, and combinations of the same.

* * * * *